United States Patent [19]

Van Horn

[11] 4,417,725

[45] Nov. 29, 1983

[54] METHOD FOR TRANSFERRING ENERGY BETWEEN SUSPENDED OBJECTS

[76] Inventor: John W. Van Horn, 2953 Waterfield Dr., Sparks, Nev. 89431

[21] Appl. No.: 312,242

[22] Filed: Oct. 19, 1981

[51] Int. Cl.³ ..... A63G 9/00

[52] U.S. Cl. ..... 272/85; 46/51; 46/236; 272/1 R; 434/302

[58] Field of Search ..... 272/1 R, 85 R, 8 N, 272/87, 88, 89, 90, 61, 91; 273/413; 297/273–281; 434/302, 300; 46/51, 47, 234–236

[56] References Cited

U.S. PATENT DOCUMENTS

| | | | |
|---|---|---|---|
| 1,481,075 | 1/1924 | Strouse | 434/300 |
| 2,545,295 | 3/1951 | Miller | 272/85 |
| 3,521,848 | 7/1970 | Kaase | 272/85 |
| 3,702,699 | 11/1972 | Smith | 273/1 R |
| 3,918,709 | 11/1975 | Bishop | 272/85 |

OTHER PUBLICATIONS

"Welch Laboratory Apparatus", p. 181, 3/26/65.

*Primary Examiner*—Richard C. Pinkham
*Assistant Examiner*—T. Brown
*Attorney, Agent, or Firm*—Herbert C. Schulze

[57] ABSTRACT

This invention is a method and apparatus for alternately transferring energy between two objects suspended from a common swiveled point. The first of the objects is put into motion in a circular fashion about the second object which is in a stationary condition. Ultimately, energy is transferred from the first object to the second object, causing the second object to follow the first object in a circular manner. The resulting transfer of energy slowly brings the first object to a stationary condition and moves the second object in a circular motion. A transfer of energy then continues between the first and second objects in the aforementioned manner. Swings containing humans also transfer energy from one swing to another as characterized by this invention. The invention is further characterized by means for changing the position of the common meeting point of the suspension lines from each object.

2 Claims, 21 Drawing Figures 110
112
112a
112b
112c
114
116
116a
116b
116c
116d
118
120
120a
120b
120c
120d
120e
120f
120g
122
122a
122b
122c
122f
122g
124
126
128
130

212
214
216
218b
218a 210
222
222a
222b
220
220a
220b
224
226
228
212
214
216
218a
218b
230a
230b
222
220

312
316
321
327
326
324
328
312
314
316
318
319

321
322
320
310
325
323
320a
320b
322a
322b
326
324
328

FIG. 19.
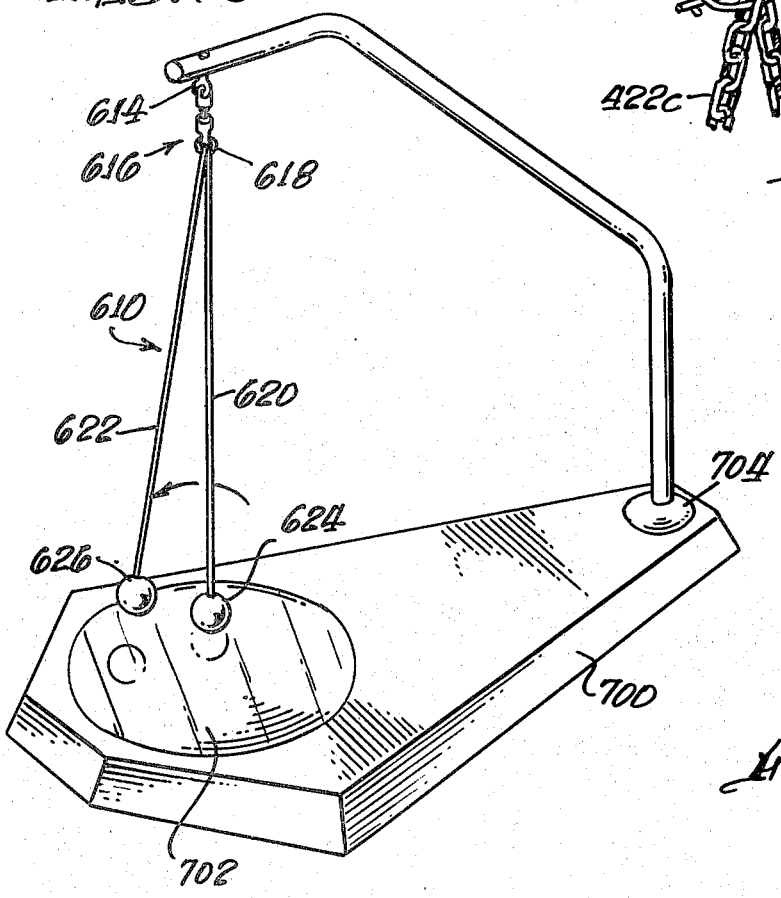
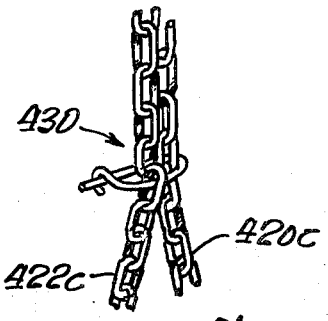
FIG. 17.
FIG. 18.
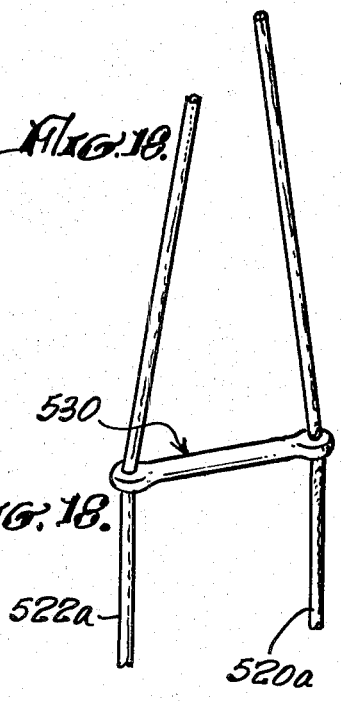
FIG. 20.
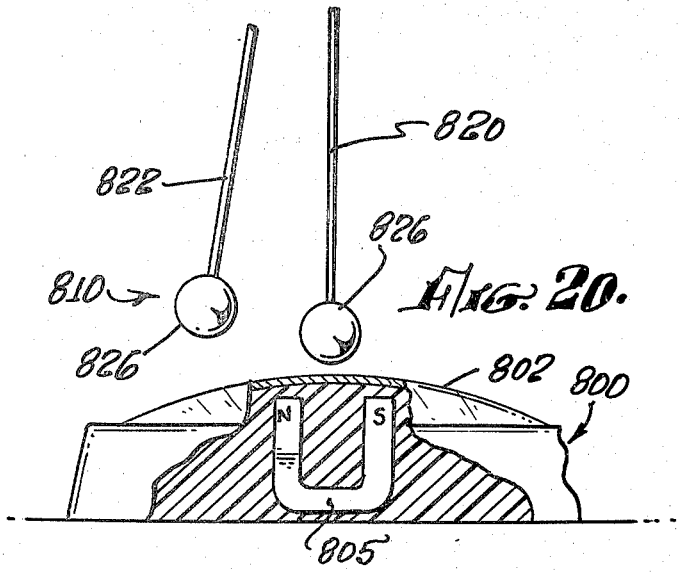
FIG. 21.
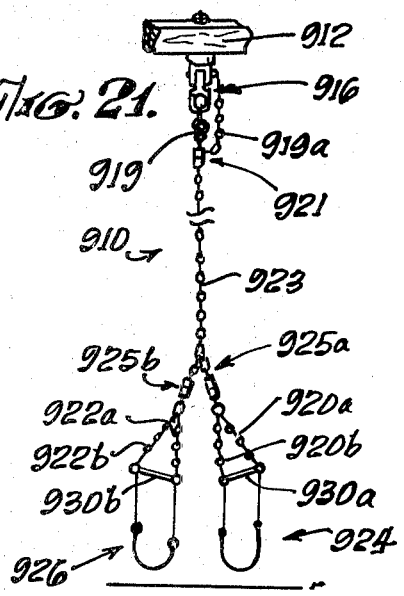

METHOD FOR TRANSFERRING ENERGY BETWEEN SUSPENDED OBJECTS

CROSS REFERENCE TO RELATED PATENT APPLICATIONS

There two patent applications filed by me relating to the present application: Ser. No. 273,331 filed June 15, 1981, for ENERGY ALTERNATING SWING METHOD AND APPARATUS, now pending; and Ser. No. 273,330 filed June 15, 1981 for SWING SUPPORT, now pending.

BACKGROUND OF THE INVENTION

1. Field of the Invention

This invention is in the general field of swinging objects suspended by a cord, or the like, and is more particularly directed to such devices where the two swinging objects are suspended from a common swiveled point. The invention is even more particularly directed to such a device wherein there is a method for swinging one object about the other, wherein energy is transferred from the swinging object to one which is stationary. Ultimately, the said second object acquires the momentum produced by the first object and slowly comes to rest. The invention is more particularly directed to a method utilizing such objects as have been mentioned for an entertainment device for children or other persons. Swings for carrying persons may be substituted for the suspended objects.

2. Description of the Prior Art

There is literally no prior art known to me having a bearing upon the present invention other than two patents filed by me in the United States Patent and Trademark Office. A design patent bearing the serial number 273,330, and a utility patent having the serial number 273,331, were filed by me on June 15, 1981. The invention in this application utilized a different concept, but a variation, of the principle as that of the aforementioned applications.

There are many swings of various types known, and it is customary to swing heavy objects on the end of a cable, or the like. For example, it is known that to swing a heavy metal ball upon the end of a cord for purposes of demolishing buildings and for carrying a person, such a Tarzan-like swing, have been used in the past. Likewise, it is known for children to swing back and forth on a conventional type of swing supported by a pair of cords anchored above. Another type of swing has been based on a cord suspended from a rotating swivel atop a pole, such as a Maypole.

The present invention, however, comprises the utilization of two swing-like objects, each suspended from lines which originate from a common swiveled point. These swings can be rotated one about the other without entwinement in a manner which involves the transfer of energy from the moving object to one which is standing still. Ultimately, the second object gradually takes a transfer of energy from the first object and while the first object slowly comes to a halt, the second object, or swing, enters an orbit about the first object. In this respect the invention is completely unique and without precedence.

SUMMARY OF THE INVENTION

For a long period of time I have worked with swinging objects and particularly attempted to devise a different and exciting method and apparatus for inducing an unusual swinging and rotating motion to a pair of associated objects in such a manner that motion from one would be transferred to the other and vice versa in a unique manner.

I have discovered that by suspending two weighted objects from a common swiveled junction that the objects perform in a very unusual manner when one object is caused to commence a rotational movement about the second object. A very strange and unique series of interrelationships is accomplished when this situation is brought to bear. What occurs is that the first object orbiting about the second stationary object will cause the transfer of energy to the second object, causing it to follow in a similar circular direction. Then, the first object which has been set into motion slowly comes to a halt while the second object begins orbiting about the first object. When the second object begins slowing down, it again transfers energy to the first object, starting the whole cycle all over again.

This alternate exchange of energy and the exchange of orbits of the items can continue for a long period of time upon one initial impulse being imparted to the apparatus.

By coloring the two objects and their supporting means with different and bright colors, a most unusual visual appearance is achieved which is fascinating to watch and gives considerable pleasure to the observer. Carrying the procedure a step further, I have found that two persons suspended in this manner can in effect swing about each other with the same transference of energy, causing an orbit about one another in an alternating manner. This creates a most enjoyable recreational activity and a completely new and different type of swing arrangement. There is no other such motion any known swing arrangements for children or adults which approximates the unusual condition achieved by this method.

By appropriately anchoring a swiveled connection assembly to an overhead support beam, or the like, a very inexpensive and most unusual entertainment device for children, particularly, is achieved.

The placement of reflective mirror-like surfaces beneath a pair of suspended objects causes a very delightful and exciting reflective motion to the energy transferring device.

When the objects that are suspended are manufactured from a ferrous material, a magnet, which has been placed directly beneath the suspended objects, causes the objects to act in a very unusual and erratic manner.

The common junction of the lines suspending the objects can easily be lengthened or shortened in order to produce a different effect in the motion of each object.

It is an object of this invention to provide a method and means by which an object suspended from a swiveled point may be made to orbit about another suspended object from the same common swiveled point in such a manner that the suspension means causes the first object, when put into motion, into a circular direction, to transfer its orbiting motion to the other stationary object and will in itself come to a non-rotating position. The energy which is transferred to the second object will then allow it to perform the same transfer of energy to the object which has been placed at rest.

Another object of the invention is to provide a method of using a swing by children and others to provide a unique, and novel entertaining motion.

Another object of this invention is to provide a fascinating, time-passing and entertaining method for observers.

A further object of this invention is to develop a curiosity and the search for knowledge in an observer so that he may pursue the laws of physics in order to find out answers as to why this motion takes place. Thus, this device becomes an educational aid for children, and the like.

The foregoing and other objects and advantages will become apparent to those skilled in the art upon reading the description of a preferred embodiment which follows in conjunction with a review of the appended drawings.

BRIEF DESCRIPTION OF THE DRAWINGS

FIG. 16 is a schematic representation of yet another alternate embodiment of the showings of FIGS. 10 through 12;

FIG. 17 is a fragmentary perspective showing an alternate embodiment of suspension line connecting junctions of the showings of FIGS. 8 and 14;

FIG. 18 is a fragmentary perspective showing a method of separating the swing suspension lines;

FIG. 19 is a perspective of an alternate embodiment of the device of FIG. 1;

FIG. 20 is an enlarged fragmentary side elevation, partly in section, showing an alternate embodiment of the device of FIG. 19; and FIG. 21 is a fragmentary perspective of an alternate embodiment of swivel assembly which can be utilized in my invention.

DESCRIPTION OF A PREFERRED EMBODIMENT

Figure 1:
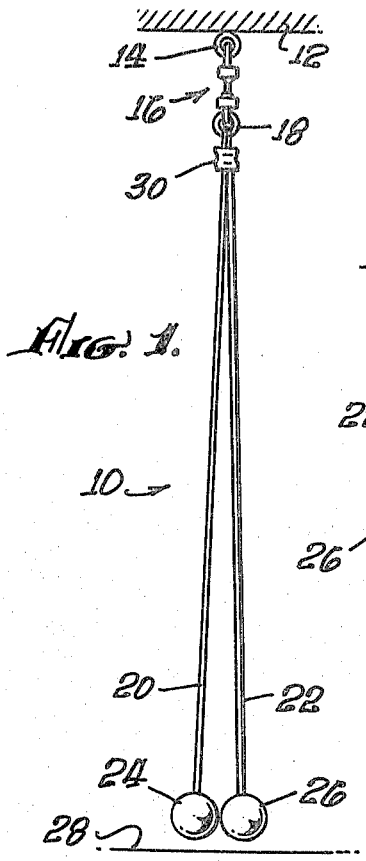
FIG. 1 is a simplified side elevation of the METHOD AND APPARATUS FOR ALTERNATELY TRANSFERRING ENERGY BETWEEN SUSPENDED OBJECTS.

I have illustrated in FIG. 1 a simplified version of a device for alternately transferring energy between a pair of suspended objects. The reference numeral 10 indicates, generally, the apparatus of the invention. A support beam 12, having an eyelet 14, supports a swivel assembly 16. Depending from the swivel assembly 16 is a connecting element 18, from which suppporting lines 20 and 22 are suspended. Affixed to the lines 20 and 22 are items or objects 24 and 26. These objects are in this manner suspended from the beam 12 at a distance slightly above a ground surface 28.

Figure 2:
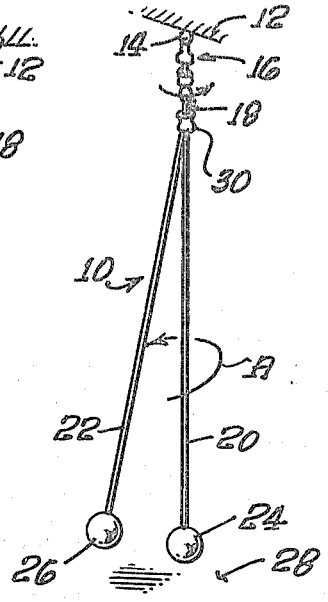
FIGS. 2, 3 and 4 are perspectives on a reduced scale showing the method in which energy is transferred alternately between the objects of FIG. 1.

As indicated in FIG. 2, a force is applied to the object 26 in a circular direction, as indicated by the arrow A. As the item 26 continues to orbit the stationary object 24, which is suspended from a common junction with the line 22, the transferral of energy takes place which slowly decreases the arc of the object 26 and slowly begins to pull the line 20 with its object 24 into a circular motion similar to that of the initial thrust of the object 26.

Figure 3:
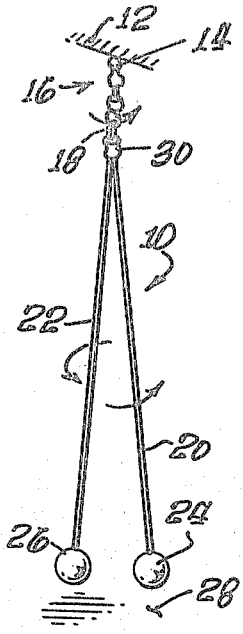

FIG. 3 shows the condition where the object 26 has now slowed down in its motion to just about the same circular diameter of the object 24, which now is acceleration its motion.

Figure 4:
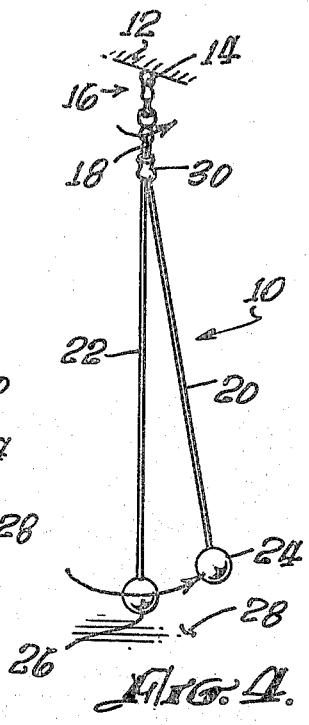

FIG. 4 illustrates the initial moving object 26 as now at rest and the object 24, which has accepted the energy transfer, is now fully rotating in an orbit about the object 26. This energy transfer alternately takes place between the two suspended objects in a unique and fascinating manner for an observer.

The length of the lines 20 and 22 can be changed so as to permit their common junction point to be either closer or farther away from the suspended objects, and being accomplished by means of a sliding collar 30. In FIGS. 1 through 4, the collar 30 is at its upper most position, providing a longer length for both lines 20 and 22.

Figure 5:
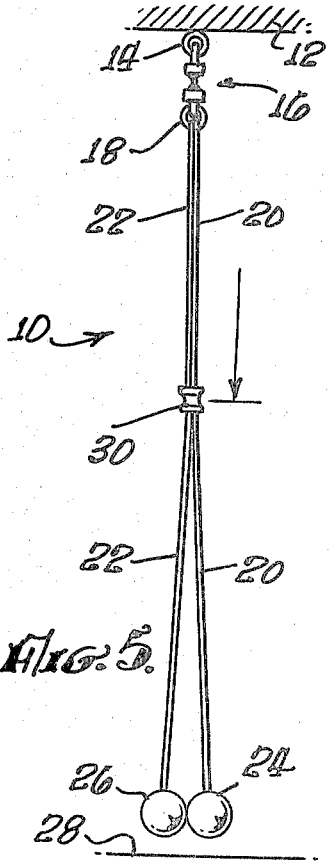
FIG. 5 is a view similar to FIG. 1 but showing the device in another configuration.

FIG. 5, however, shows the collar 30 having been moved downwardly along the pair of lines a sufficient distance for the purpose of making the lines 22 and 20, at their lower ends, into a shorter line between the objects 24 and 26 and newly created junction point 30.

I have found that this changes the speeds and the character of the rotation of the objects 24 and 26 about one another.

Figure 6:
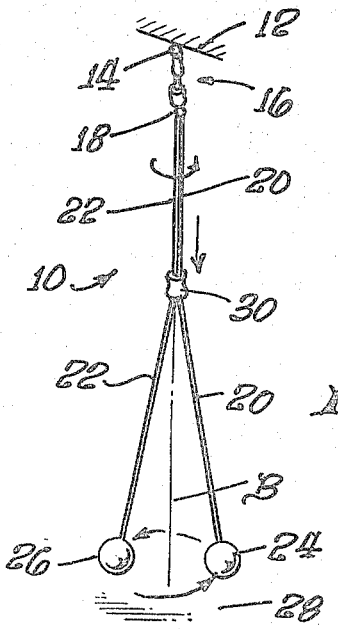
FIG. 6 is a schematic perspective on a reduced scale showing an energy transferring effect of the device of FIG. 5.

The schematic illustration in FIG. 6 shows the objects 24 and 26 moving in an orbit about the vertical axis B and transferring their energy alternately as previously described. Here, both suspended objects are shown in a state where they are equally balanced for an instant before being brought into the transferrance procedure described earlier.

Figures 7, 8, 9, 10, 11, 12:
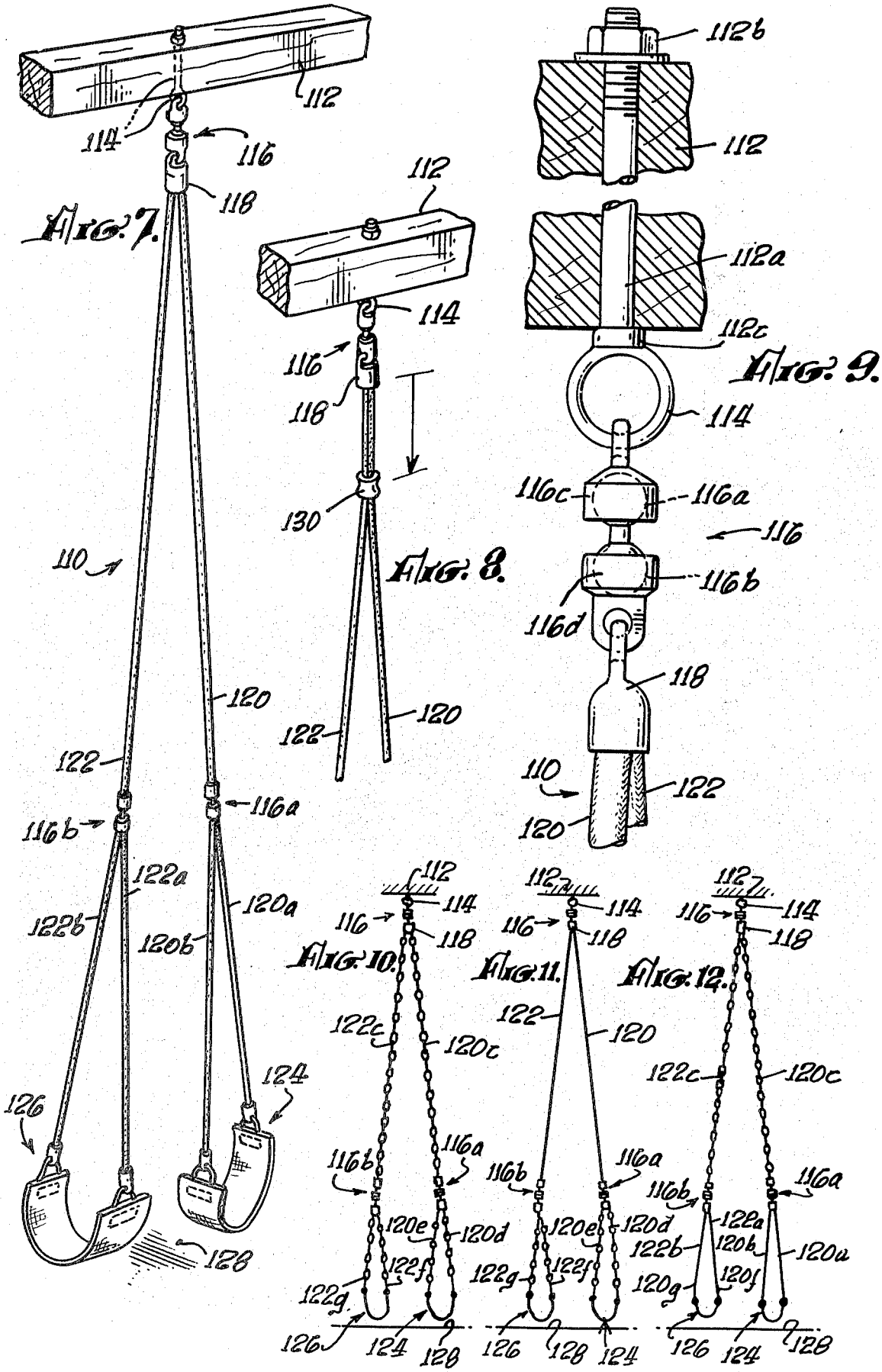
FIG. 7 is a perspective of a pair of swings utilizing the principles of the invention.
FIG. 8 is a fragmentary perspective showing the device of FIG. 7 with an adjustment collar incorporated thereon.
FIG. 9 is an enlarged fragmentary section with certain parts in elevation of one form of swivel connection which can be applied to the devices of FIGS. 1 through 8.
FIGS. 10, 11 and 12 are schematic side elevations on a reduced scale of the device of FIG. 7.

In FIG. 7, I have shown a more detailed perspective of a swing assembly which utilizes the principles of my invention. The swing assembly 110 is supported from a beam 112 through connecting element 114, through the swivel assembly 116, through element 118, and through lines 120 and 122. The particular showing of FIG. 7 illustrates an embodiment which can include subsequent swivel assemblies **116*a* and 116*b* from which depending swing assemblies 124 and 126 suspend. Secondary support lines 120*a* and 120*b* connect the swing assembly 124 to the swivel connection 116*a*. The second swing assembly 126 is suspended from the swivel 116*b* by means of secondary lines 122*a* and 122*b*. Thus, the swings are supported from the beam 112 a short distance above the ground level 128**.

I have found that the length of the support lines 120 and 122 can be varied by means of a collar 130 which is easily moved up or down as shown in the fragmentary perspective of FIG. 8.

A simple swivel assembly used in my device, as shown in the FIGS. 1 through 7, is illustrated in the section of FIG. 9. The beam 112 supports a bolt 112*a* which is fastened to the beam by means of a fastening assembly 112*b*. Support ring 114 is affixed to this bolt 112*a* at the enlargement area 112*c*. The swivel assembly 116 has upper and lower spherical members 116*a* and 116*b* which are freely rotatable within enlargements 116*c* and 116*d*, respectively. The aforementioned connecting member 118, having primary lines 120 and 122 affixed thereto, completes the swivel assembly. This is only an example of a swivel assembly that can be used. Others can be furnished by those skilled in the art. Later in this application I have illustrated an alternate embodiment of swivel combination.

In FIG. 10 I have shown that the primary lines of the device of FIG. 7 can comprise chain link elements 120*c* and 122*c*. The secondary lines affixed to the swivel assemblies 116*a* and 116*b* comprise chains 120*d* and 120*e*, which in turn support the first seat assembly 124. Seat 126 is supported by the secondary chains 122*f* and 122*g*. In turn, the pair of suspended seats is spaced above the surface 128 sufficiently to allow a person to sit in the seats and to swing in the fashion presented earlier in this application.

In FIG. 11, which is similar to FIG. 10, the primary lines 120 and 122 can be of a cord, or rope, construction and have the lower secondary chain assemblies of FIG. 10 to support the seats 124 and 126 above the surface 128.

FIG. 12 shows a further combination of suspension elements which include primary lines 120*c* and 122*c* of chain construction and secondary lines 120*a* and 120*b* of cable or rope. Lines 122*a* and 122*b* supporting the seat assemblies 124 and 126 are shown of rope. It can be seen that various types of interchanging support lines of various construction can be employed to suit the particular need of the swing assemblies 110.

Figures 13, 14, 15:
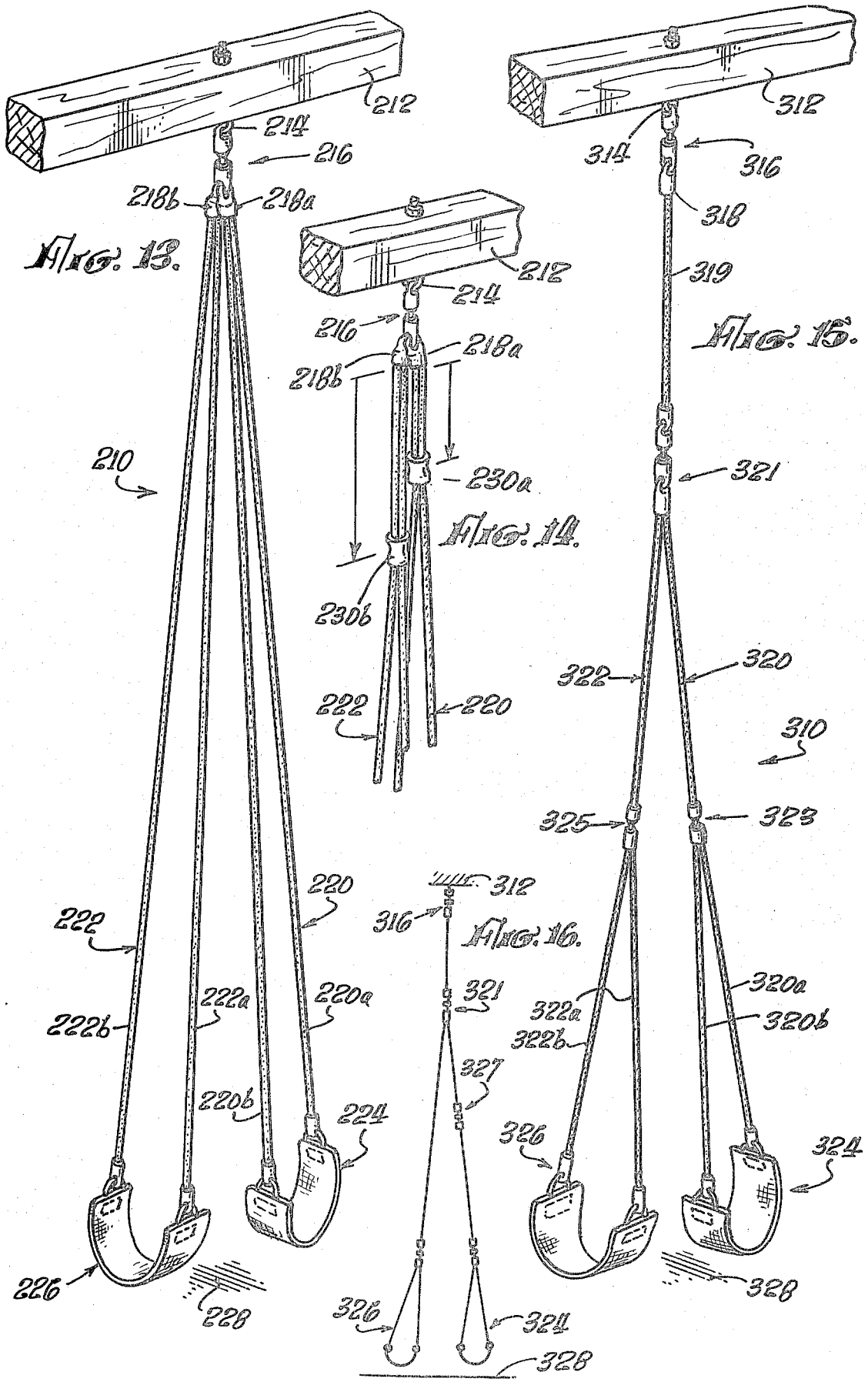
FIG. 13 is a perspective of an alternate embodiment of the device of FIG. 7.
FIG. 14 is a fragmentary perspective illustrating an alternate embodiment of the illustration of FIG. 8.
FIG. 15 is a perspective showing a further alternate embodiment of the devices of FIGS. 7 and 13.

FIG. 13 illustrates an alternate embodiment of suspending a pair of swings from a common swiveled connection point. This assembly is inticated by the reference numeral 210. From the support beam 212 through eyelet 214 a swivel connection 216 incorporates the suspension of connecting elements 218*a* and 218*b*. In this embodiment the support line assemblies 220 and 222 each comprise a pair of lines 220*a* and 220*b*, along with lines 222*a* and 222*b* to support seat assemblies 224 and 226. The common junction point, in this case, does not bring both support line assemblies to a primary support line as that shown in FIG. 7. In this case the swing assembly 210 is supported above the ground surface 228 directly to the swivel assembly 216 without any primary support lines or any additional swivel connecting members.

FIG. 14 shows a pair of length-determining collars 230*a* and 230*b* as applied to the pairs of lines 220 and 222 in order to change the length of the supporting lines from the seat assemblies to the swivel point.

As shown in FIG. 15, the overall swing assembly 310 is supported from a beam 312 through eyelet 314 by means of swivel 316 and connecting element 318. In this case, an additional support line 319 becomes the primary support line and has an additional swivel assembly 321. Secondary lines 320 and 322 are interposed between swivel assembly 321 and a pair of swivel members 323 and 325. The swing assemblies 324 and 326 are shown to be supported from swivels 323 and 325 by support lines 320*a*, 320*b*, 322*a*, and 322*b*. I have found that the placement of lines such as 319, along with various swivels between the support beam 312 and the swing seats 324 and 326, produces countless variations in the swing apparatus action. The action is enhanced by persons working together in the swings and causing variations in the orbiting by thrusting their bodies into certain directions while swinging.

FIG. 16 shows an alternate embodiment of the FIG. 15 device, wherein a swivel member 327 serves to produce a slightly different action of the swing assembly by varying the movements involved.

In the fragmentary perspective of FIG. 17, I have indicated a clip 430 which can be inserted along the length of lines 420*c* and 422*c* in order to vary the junction point along the chains.

I have also found that in many cases a spreader bar 530 being placed between swing support lines 520*a* and 522*a* allows the user of a swing to better avoid contacting the support lines as they meet at their common junction.

The swings illustrated in FIGS. 7 through 18 are shown to be capable of being constructed from various types of inter-connecting and suspending lines in order to suit the purpose of the climatic conditions of the availability of materials. If it is desired, the support lines could have a suspension method as is used in baby supporting swings. The types of swing seats can be produced that would serve more properly the type of person being supported. Plain, flat-board type of swings can be substituted for the strap-like swings herewith illustrated.

In FIG. 19 I have shown an entertainment device utilizing the same principles as have been described in all of the previous figures. The assembly 600 includes a base 700 to which a swing support member 612 is affixed at 704. The support member 612 has an eyelet 614 to which a swivel assembly 616 is attached. Connecting element 618 thus supports an object assembly 610 which comprises suspension lines 620 and 622. Weighted objects 624 and 626 are affixed to the lower ends of the support lines and can be manipulated into the alternating transfer of energy from one to the other. I have found that by the addition of a convex mirror 702 to the base 700 allows a reflective surface of the mirror to reflect the unique movement of the weights 624 and 626. The addition of the mirror has shown to enhance the entertaining qualities of the energy transferring device.

FIG. 20 illustrates a base assembly 800. This base assembly is similar to the base assembly 700 in FIG. 19 except for the addition of a horseshoe magnet 805. This assembly has a mirrored surface 802 and objects 824 and 826 supported by means of lines 820 and 822. The magnet causes the weights to act in odd ways, providing an entertaining device to watch. The weights are formed of ferrous material in order to be affected by the magnet.

FIG. 21 is a fragmentary perspective showing an alternate embodiment of swivel connection. I have found that because of the excessive load created by the support of persons in swings that a unique swivel assembly had to be devised. In the illustration shown, the upper support beam 912 is provided in order to allow the first swivel assembly 912 to be mounted. Interconnecting the first swivel assembly to a second swivel assembly 921 is a linkage means 919. For safety purposes a safety chain 919*a* is affixed to the lower portion of the first swivel assembly and to the upper member of the lower second swivel assembly. Primary support cord 923 supports secondary support cord members which are shown as a first pair of swing support cords 920*a*, 920*b* and 922*a* and 922*b*. The swings 924 and 926 have spreader bars 930*a* and 930*b* located at points between the swings and the junction of the swing support cords and the primary support cord. A pair of swivels placed just below the junction point are shown at 925*a* and 925*b*. I have found that this arrangement provides a swing support means that properly allows the energy transfer means described earlier in this application to perform in a very smooth and safe manner.

While the embodiments of this invention specifically shown and described are fully capable of achieving the objects and advantages desired, it is to be understood that such embodiments have been shown for purposes of illustration only and not for purposes of limitation.

I claim:

1. The method of transferring energy and motion between two suspended objects which comprises: Suspending a first object at a predetermined distance above a base level from a single point; suspending a second object at a predetermined distance above a base level from said single point and at the same level as said first object; providing a swiveled connection at the common junction of said first and said second objects; imparting a circular motion to the first of said suspended objects above the said second suspended object; causing said first suspended object to increase its speed and orbit about the second suspended object for a period of time; causing the second suspended object to obtain motion from the first suspended object to lose momentum and motion by transferring from its suspension means its kinetic energy to the second object; causing the second object to increase its momentum and transfer of kinetic energy from the first until the first comes to rest with the second still in motion.

2. The method as set forth in claim 1 wherein said first and second suspended objects are swings for supporting persons.

* * * * *